US006185310B1

(12) United States Patent
Kermani et al.

(10) Patent No.: US 6,185,310 B1
(45) Date of Patent: Feb. 6, 2001

(54) PLANAR MAGNETIC ACOUSTICAL TRANSDUCER STAMPED POLE STRUCTURES

(75) Inventors: Mohammad Kermani, Vancouver; Scott Phillips, Victoria, both of (CA); F. Bruce Thigpen, Tallahassee, FL (US); Marc Delorme; Michael Montour, both of Vancouver (CA)

(73) Assignee: Eminent Technology Incorporated, Tallahassee, FL (US)

( * ) Notice: Under 35 U.S.C. 154(b), the term of this patent shall be extended for 0 days.

(21) Appl. No.: 09/121,182

(22) Filed: Jul. 23, 1998

Related U.S. Application Data

(63) Continuation-in-part of application No. 08/936,120, filed on Sep. 24, 1997.

(51) Int. Cl.[7] ..... H04R 25/00
(52) U.S. Cl. ..... 381/431; 381/399; 381/408
(58) Field of Search ..... 381/408, 412, 381/141, 421, 422, 431, FOR 156, FOR 163

(56) References Cited

U.S. PATENT DOCUMENTS 3,873,784 3/1975 Doschek .
5,901,235 * 5/1999 Thigpen et al. ..... 381/431

FOREIGN PATENT DOCUMENTS 20013 2/1977 (JP) .
37419 3/1977 (JP) .
38915 3/1977 (JP) .
2043003 9/1990 (RU) .

* cited by examiner

*Primary Examiner*—Huyen Le
(74) *Attorney, Agent, or Firm*—Dowell & Dowell, P.C.

(57) ABSTRACT

A planar magnetic acoustical transducer including a diaphragm with electrical circuit carrying conductors having a width substantially equal to a combined width of a plurality of magnetic fields created by equally spaced opposing rows of permanent magnets carried by opposing frame sections between which the diaphragm is mounted such that substantially the entire active area of the diaphragm is driven to create a smooth frequency response. The electrical circuit includes generally parallel segments which are aligned within the magnetic fields created by the rows of opposing magnets and are spaced at a distance relative to one another generally not less than a distance equal to a width of pole elements which are integrally formed with the frame sections and which pole elements are spaced intermediate each of the rows of magnets so as to be in an opposing relationship with one another on opposite sides of the diaphragm.

13 Claims, 2 Drawing Sheets

PLANAR MAGNETIC ACOUSTICAL TRANSDUCER STAMPED POLE STRUCTURES

CROSS REFERENCE TO RELATED APPLICATIONS

This application is a continuation-in-part application of U.S. application Ser. No. 08/936,120, filed Sep. 24, 1997, in the name of F. Bruce Thigpen and Claude Jeff Raley, entitled Enhanced Efficiency Planar Transducer.

BACKGROUND OF THE INVENTION

1. Field of the Invention

This invention is generally directed to transducers which incorporate a vibrating diaphragm, and more specifically, to planar magnetic acoustic transducers which include permanent bar magnets mounted in spaced rows on opposite sides of the diaphragm on which an electrical conductor circuit has been applied. The invention includes pole elements formed in opposing frame sections between which the diaphragm is mounted so that the pole elements are spaced intermediate each of the rows of magnets on opposite sides of the diaphragm. The spacing and size of the rows of magnets and pole elements is such as to ensure that substantially the entire active area of the diaphragm is driven except at points intermediate the opposing pole elements to thereby provide for a smoother frequency response for the transducer when in use.

2. History of the Invention

In microphone transducers, acoustic pressure variations act on a diaphragm surface causing the diaphragm to vibrate. The resultant vibrations of conductors associated with the diaphragm, while retained within a magnetic field of the transducer, create a voltage signal of similar time variance and intensity characteristics as the acoustic signal used to supply the conductors of the diaphragm. In a loudspeaker transducer, an audio signal current flows through conductors of a diaphragm. Current flowing through the conductors reacts with the magnetic field of magnets mounted in proximity to the diaphragm, thereby causing magnetic forces to act on the conductors that create sound pressure waves along the diaphragm surface which are proportional and synchronous to audio signals applied to the conductors.

Diaphragms of planar magnetic loudspeakers are normally held loose or under tension in a plane parallel to the pole faces of one or more permanent magnets so as to be in the static magnetic field of the magnets. An active surface area of the diaphragm, which is an area of the diaphragm which is not constrained from motion by a rigid supporting frame to which the diaphragm is attached, is vibrated when electrical signals are provided to the conductor circuits attached to the diaphragm. Conductors are attached to the diaphragm in runs which, in many transducers, are generally parallel with the edges or pole faces of the permanent magnets. The path of the conductors on the diaphragm is chosen so that current flowing therethrough produces net magnetic forces of uniform direction for all of the conductor segments or runs along the active surface of the diaphragm by causing the general direction of diaphragm motion to always be perpendicular to the diaphragm surface.

The diaphragm active surface area is chosen for particular acoustic response characteristics, such as frequency response or dispersion. The spacing of conductors and the adjacent magnets are chosen so that the diaphragm is uniformly driven across its entire active surface area for low distortion or maximum band width. As an alternative, the conductor spacing may be chosen for optimum efficiency for a particular frequency band width or for various other reasons. The electrical circuit formed by conductor runs or segments on the diaphragm is designed concurrent with the arrangement of permanent magnets so that sufficient magnetic field strength and proper magnetic field orientation is provided to all active conductor segments or runs to achieve adequate transducer efficiency. This "useful" magnetic field is provided substantially parallel to the diaphragm.

Conductor runs on the diaphragm may take a variety of configurations, including round or rectangular. The conductors may be bonded to a diaphragm or chemically etched from foil laminates. The conductor dimensions, compositions and circuit arrangements are often chosen to meet a desired circuit impedance requirement for maximum efficiency within practical limitations. At the present time, aluminum conductors are preferably utilized for conductors due to lower mass and lower overall mass-resistivity product produced over other conductor metals. Lower mass has an inherent advantage for fast transient response and lower mass-resistivity product equates to higher efficiency.

The magnet materials are chosen for cost, ease of fabrication and magnetic parameters. Optimal magnet spacing, geometry and dimensional criteria may vary the magnetic material utilized in a particular application. An air gap dimensions, the spacing between a diaphragm of magnetic transducers and the magnets thereof, should be minimized for maximum efficiency but must be chosen to allow for adequate diaphragm motion at low frequencies. The optimum spacing between adjacent magnets of each assembly is also influenced directly by the air gap dimension.

The advantages of planar magnetic loudspeakers over other electromagnetic arrangements is that planar magnetic loudspeakers have lower distortion and more accurate phase response when compared to cone radiator type loudspeakers. U.S. Pat. No. 3,939,312 to McKay discloses a push-pull type planar magnetic transducer arrangement wherein magnets are positioned to direct a magnetic flux across the diaphragm at a slant angle with conductor runs applied to the diaphragm. In U.S. Pat. No. 4,471,173 to Winey, another push-pull magnetic arrangement is shown wherein magnets are positioned in alternating sets of rows so that magnetic fluxes are supposed to be directed tangential to the diaphragm from the north pole face of one magnet to the south pole face of an adjacent magnet and so forth across the width of the transducer with the magnets in opposing assemblies of magnets on opposite sides of a diaphragm providing repellant magnetic forces to bound the path of the magnetic flux field.

In U.S. Pat. No. 4,337,379 to Nakaya, arrays of square magnets alternating in polarity are disclosed which are retained in two similar assemblies of equivalent magnetic pole structures with a diaphragm contoured with conductor patterns arranged to minimize resonance mode inherent in some planar transducer designs.

Each of these magnetic transducer designs and other prior art structures create a long, and therefore low, permanence path for the magnetic flux from the pole faces of the magnets proximate to the conductors carried by the sound producing diaphragms. Gauss' law dictates that the flux of each permanent magnet must form a closed loop through both poles of each magnet and take the highest permanence path from pole face to pole face. Therefore, the longer the flux path, the less efficient the transducer.

SUMMARY OF THE INVENTION

This invention is directed to planar magnetic acoustical transducers having optimized operating efficiencies and, more specifically, to such transducers which are utilized as speakers for generation of sound. The transducers include housings defined by opposing metallic frame sections between which is mounted a flexible sound generating diaphragm on which electrical conductor runs are applied for receiving electrical signals from an outside source. The opposing frame sections each have an inner surface which supports a plurality of rows of permanent bar magnets and which rows are secured thereto in generally equally spaced relationship with respect to one another. Spaced between the rows of magnets and from each of the rows of magnets are a plurality of pole elements which are integrally formed in the frame sections so as to extend toward the diaphragm within the housing. In the preferred embodiment, the pole elements include outer surfaces which are substantially co-planar with respect to pole faces of the magnets which are spaced closely to and on opposite sides of the diaphragm. Slots are provided through each frame section between each pole element and an adjacent row of magnets allowing sound waves to pass therethrough. Also, in the preferred embodiment, each of the magnets has a height to width ratio which is less than unity and like pole faces of the magnets are aligned with one another on opposite sides of the diaphragm.

The width of the active surface area of the diaphragm, that area of the diaphragm which is surrounded by the opposing frame sections, is generally equal to the combined width of the magnetic fields created by the rows of permanent magnets with the exception of areas of the diaphragm which are spaced intermediate the opposing pole elements. The electrical conductor runs extend within each of the magnetic fields created by the rows of permanent magnets and the runs are spaced by a distance which is generally less than the width of the pole elements that substantially the entire active surface area of the diaphragm is driven by the interaction between the electrical energy passing through the conductor runs and the magnetic field created by the rows of permanent bar magnet.

In the preferred embodiment, each of the frame sections is formed from a thin sheet of steel which is stamped to create the pole elements which are generally U-shaped in profile having outer side walls which are inclined at an angle of approximate 10° but not greater than 40° with respect to a perpendicular line extending from a back surface of each frame section toward the centrally mounted diaphragm. The height of each pole element is substantially equal to the height of the adjacent bar magnets so as to concentrate the magnetic fields and cause them to extend generally parallel with respect to the surface of the electrical conductors carried by the diaphragm when the transducers are in use. The pole elements function as extensions of the poles of the magnets which are oriented away from the conductor traces carried by the diaphragm.

In the preferred embodiment, each row of magnets includes a plurality, such as three, elongated bar magnets formed of sintered NdFeB which may be coated with a nickel, zinc or epoxy coating. The height to width ratio of the cross-sectional dimension of the magnets is preferbly such that the height is between approximately 50% to 90% of the dimension of the width of each magnet. The difference in height to width ratio facilitates automatic sorting and placement of the magnets on the frame sections and creates a stronger useful magnetic field than a reverse ratio in height to width ratio.

As the present invention is specifically designed to maximize the driven area of the active surface area of the diaphragm, the width of the pole elements should generally not be greater than 0.4 inch.

It is the primary object of the present invention to optimize the structure of a planar magnetic acoustical transducer of the type which incorporates bar magnets to create the magnetic field for interacting with current flowing through an electrical circuit pattern applied to a diaphragm so as to drive substantially the entire active surface area of the diaphragm to create a smoother frequency response during use.

It is also an object of the present invention to provide planar magnetic acoustic transducers of the type which incorporate permanent magnets wherein single stamped steel pieces are utilized as the stator support frames for a diaphragm and wherein the stator frame sections are stamped to provide intermediate pole elements for purposes of controlling the magnetic fields to create a greater density of the fields generally parallel to the surface of the diaphragms when the transducers are in use.

It is another object of the present invention to provide a planar magnetic acoustical transducer which is specifically designed to be assembled utilizing automated manufacturing processes such that the cost of the transducer is substantially reduced while maintaining output performance within a predetermined frequency range.

BRIEF DESCRIPTION OF THE DRAWINGS

A better understanding of the invention will be had with reference to the accompanying drawings wherein.

DESCRIPTION OF THE PREFERRED EMBODIMENT

Figure 1:
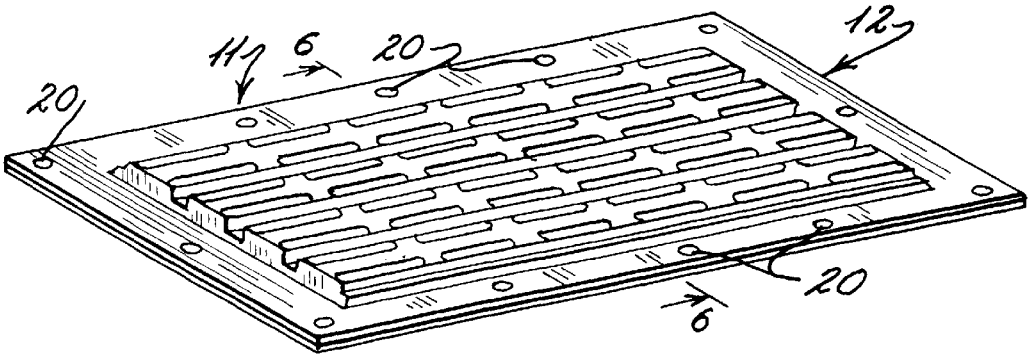
FIG. 1 is a top perspective view of an assembled transducer of the present invention.

With continued reference to the drawing figures, an electrical magnetic acoustical transducer or speaker 10 is shown as including a housing or stator member 11 defined by opposing frame sections 12 and 13. Each frame section includes an outer surface generally shown at 14 in FIG. 2 and an inner surface generally shown at 15 in FIG. 2. The frame sections are formed of a mild magnetic steel material having a material thickness of between approximately 0.030 to 0.060 inch with a material thickness of 0.050 inch being preferred for purposes of providing sufficient mechanical strength and stiffness while being light-weight and also being of sufficient rigidity to prevent undesirable vibration of the frame sections when the transducer is in use. The steel material is also provided to conduct magnetic fields without substantial saturation in a manner which will be described in greater detail hereinafter.

Figure 6:
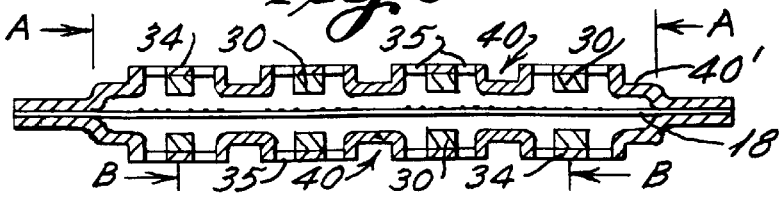
FIG. 6 is a cross-sectional view through the transducer of FIG. 1.

Each of the frame sections includes on the inner surface thereof a peripheral border 16 which, as shown in FIG. 6, is generally planer so that the border forms a clamping surface for engaging an outer peripheral edge 17 of a flexible diaphragm 18 which is retained therebetween. As shown in FIG. 6, the peripheral border 16 of the frame sections 12 and 13 are elevated so as to extend in a plane which is spaced outwardly from the remaining portions of the frame sections for purposes of which will be described in greater detail. The frame sections are retained in clamping engagement on opposite sides of the diaphragm material by use of suitable fasteners such as screws or rivets 20.

The diaphragm material is flexible so as to provide proper resonance and is preferable formed of a polyester film which is approximately one mil or less in thickness. The flexible diaphragm is clamped between the transducer frame sections in such a manner that a predetermined tension is maintained generally uniformly across the surface of the active surface area of the diaphragm. The portion of the diaphragm space inwardly of the frame sections is referred to as the "active" or the "sound producing" area of the diaphragm and is that area generally between A—A of FIG. 6. This is the portion of the diaphragm that vibrates when the transducer is in use.

Figure 2:
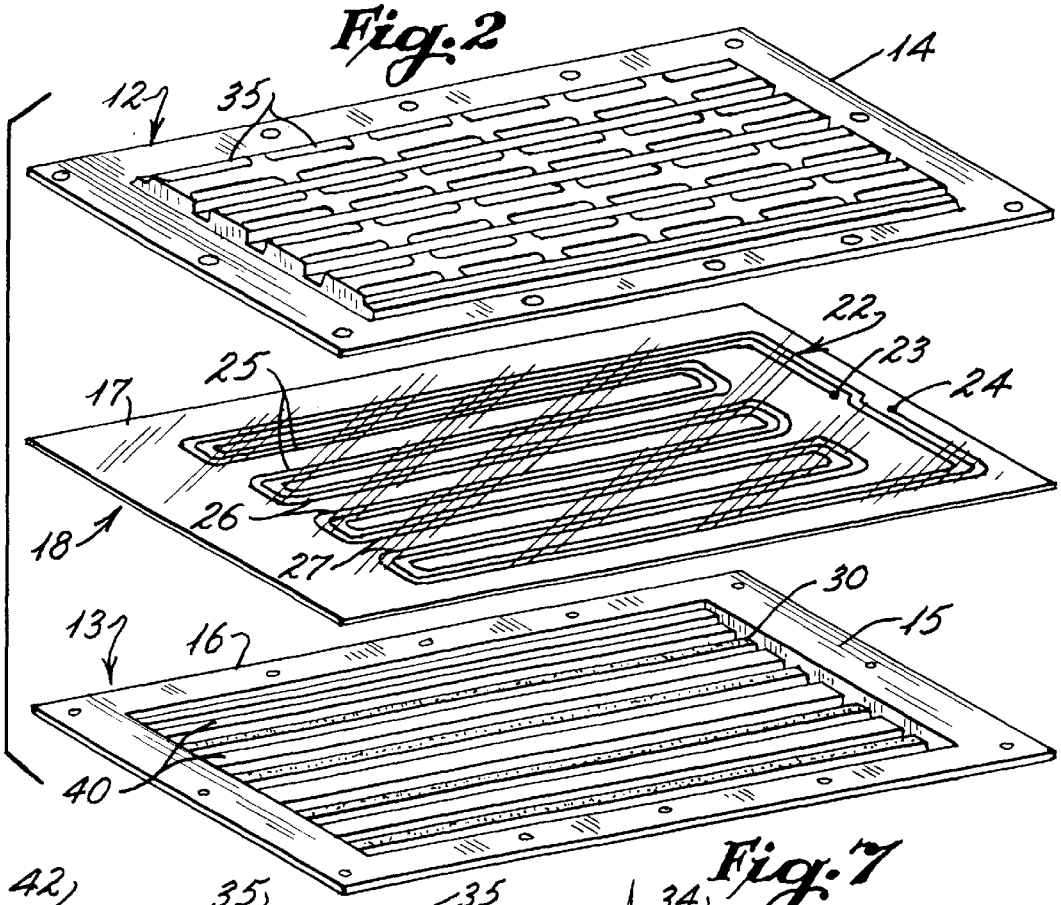
FIG. 2 is an assembly view of the transducer shown in FIG. 1.

An electrical circuit 22 is applied to or formed on one surface of the diaphragm 18 and includes a terminal 23 and a terminal 24 which are aligned so as to contact electrical terminals (not shown) of the frame sections which terminals are connected to electrical conductors which extend to a source of electrical power. As shown in FIG. 2, the electrical circuit includes three electrical conductor segments 25, 26, and 27 each having multiple traces and which are generally parallel with respect to one another across substantially the entire width of the active surface area of the diaphragm. Each conductor segment or conductor run is spaced from one another by a distance "D" which is of a predetermined dimension which will be described in greater detail. The electrical circuit is preferable formed of an aluminum which may be applied to the surface of the diaphragm or etched from a metallic layer forming a laminate from which the diaphragm may be constructed.

The transducer of the present invention is known as a two sided transducer and therefore includes magnets 30 which are mounted on opposite sides of the diaphragm as shown in FIG. 6. The magnets mounted to each frame section are aligned with like poles facing each other on opposite sides of the diaphragm to provide magnetic field components substantially parallel to the diaphragm and therefore provide a maximum useful field. When electrical current is applied through the electrical circuit, the electrical current will be subjected to the magnetic fields created by the magnets 30 and, as the magnets are located on opposite sides of the diaphragm material, the diaphragm will be moved or vibrated by the influence of the opposing fields on opposite sides of the diaphragm.

The present invention uses permanent magnets with the magnets being oriented in a plurality of rows 32 with each row including a plurality of elongated bar magnets. As shown in the drawings, four rows 32 of magnets are preferred as being mounted to the support frames with each row including three magnets mounted in end-to-end relationship. The magnets are preferably formed from a sintered NdFeB or SmCo material. As the SmCo material is more brittle and magnetically weaker than the NdFeB material and more costly. In most instances, the NdFeB material will be utilized with the present invention. However, where operating ranges for the transducers may exceed an 120° C., the SmCo magnets may be substituted for the NdFeB magnets.

Figure 7:
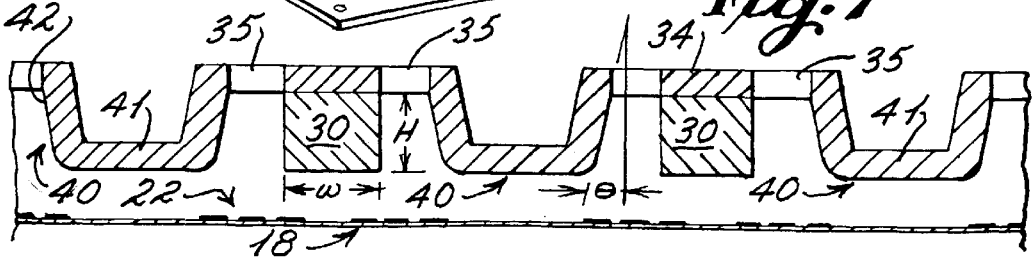
FIG. 7 is an enlarged partial cross-sectional view taken along line 7—7 of FIG. 5.
Figure 3:
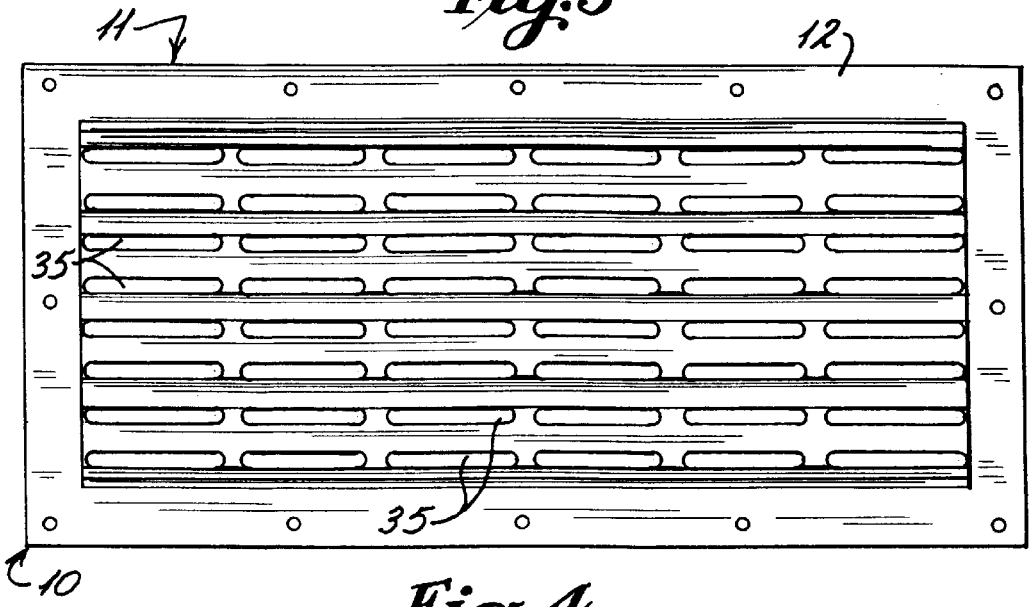
FIG. 3 is a top plan view of the transducer shown in FIG. 1.
Figure 4:
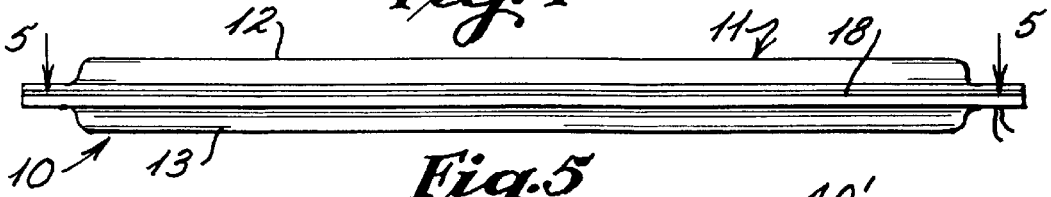
FIG. 4 is a side elevational view of the transducer shown in FIG. 1.
Figure 5:
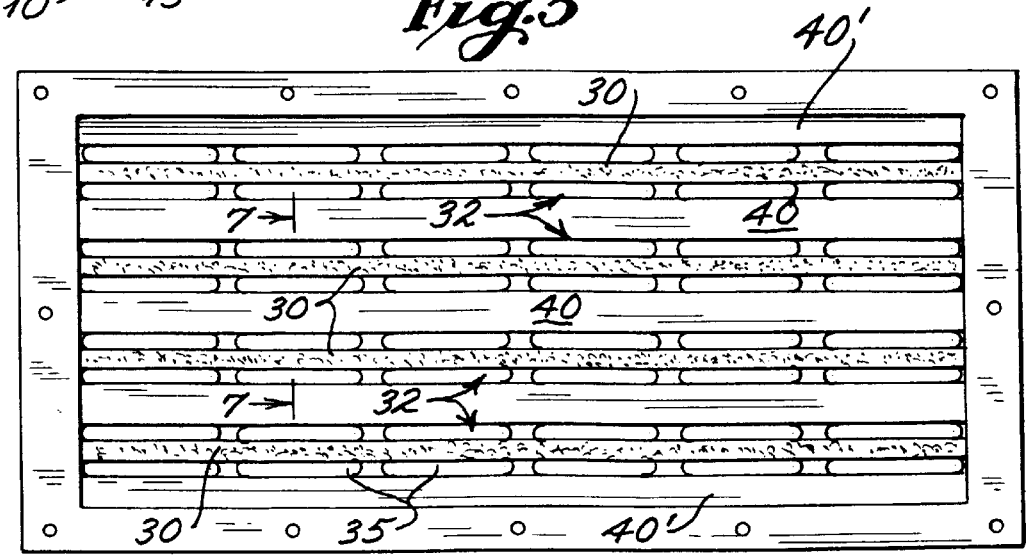
FIG. 5 is a cross-sectional view taken along line 5—5 of FIG. 4.

As shown in FIGS. 6 and 7, each of the frame sections is stamped to provide support surfaces 34 for each of the magnets 30 of each row of magnets 32. Provided on opposite sides of each of the support surfaces 34 are a plurality of elongated slots 35. The slots are provided to allow the passage of sound waves created when the diaphragm is vibrated due to the interaction of the electrical current flowing through the electrical circuit and the magnetic fields established by the bar magnets. It should be noted that the slots 35 extend on both sides of each of the rows of magnets and extend substantially along the entire length and width of the frame corresponding to the active surface area A—A of the diaphragm.

In the preferred embodiment, each row of magnets is approximately six inches in length with each individual bar magnet being approximately two inches in length. The rows of magnets and their spacing are particularly designed to drive a substantial portion of the active area A—A of the diaphragm. The driven area of the diaphragm is that portion of the active surface area of the diaphragm wherein an interaction occurs between the electrical current flowing through the conductor runs or segments of the electrical circuit and the magnetic fields created by the magnets. The spacing of the rows of magnets is also such as to ensure that there is minimum overlapping cancellation of one magnetic field with another magnetic field across the active surface area of the diaphragm with respect to the pole location. Therefore, with the dimensions disclosed with respect to the length of the rows, in the present invention, the preferred spacing is such that the outer rows of magnets are spaced such that the center lines of such rows are approximately 1.875 inches apart, as shown at B—B in FIG. 6. The rows of magnets intermediate the outer rows are equally spaced with respect to one another.

With specific reference to FIG. 7, one of the features of the present invention which facilitates mass production of the transducers of the invention is the ability to mechanically pre-sort the bar magnets for purposes of applying the bar magnets to the support surfaces 34 of each frame section of a stator assembly 11. As shown in FIG. 7, the width "W" of each magnet is shown as being slightly greater than the height "H" of each magnet. The height to width aspect or ratio should be less than unity and between 0.5 up to 1.0. Preferably, the height should be approximately 75% of the width dimension of the magnets. The "non-unity aspect ratio" facilitates automatic sorting and placement and further preserves the magnetic field strength. It has been determined that if a reverse ratio is utilized, wherein the height greater than the width, the useful magnetic field created by the poles opposing the diaphragm is weaker. The magnets are preferably no greater than approximately 1.00 inch in height.

In the present invention, it is preferred that the magnets also be coated. The coating is preferably a nickel or zinc coating or an epoxy coating. The coatings are applied to resist corrosion. Nickel coatings are generally preferred, however, epoxy coatings offer greater corrosion resistance, however, at higher cost. In the present invention, the height of each magnet is approximately 0.09 of an inch and the width is approximately 0.13 of an inch.

Each of the stator frames is also stamped to form a plurality of inwardly extending pole elements 40 which are equally spaced intermediate each of the rows of magnets 34 as shown in drawing FIG. 6. The pole elements are spaced at between 0.050 to 0.150 inch from the adjacent rows of magnets with a spacing of approximately 0.125 inch being preferred. The inner end or face 41 of each of the pole elements is substantially co-planer with the inner poles or faces of each of the magnets. In the preferred embodiment, the pole faces of the magnets are spaced from the diaphragm material at a gap of between 0.03 inch to 0.070 inch with approximately 0.05 inch being preferred. The spacing is designed to balance between diaphragm sensitivity and excursion. Smaller gaps increase sensitivity of the diaphragm, however, reduce the output level at which the diaphragm will vibrate against a portion of the stator frame section. It is desired that the diaphragm not engage the magnets or the stator frames and thus the spacing is designed to optimize the sensitivity without interference between the diaphragm and the magnets or support frames.

The pole elements 40 are provided in order to increase the density of the magnetic fields created by the rows of permanent magnets. Each pole element acts as an extension of the pole face of an adjacent magnet which is opposite the pole face of the magnets facing the diaphragm material. Therefore, the magnetic field from the pole face of the magnets opposing the diaphragm extends outwardly and generally parallel to the surface of the diaphragm to the adjacent pole element.

With specific reference to FIG. 6, the pole elements 40 are generally U-shaped in cross section including side walls 42 which diverge outwardly from a line extending perpendicular to the back or outer surface 14 of the frame sections 12 and 13 at an angle θ of approximately 10°. It is important, that the angle θ not be greater than 40° and preferably be as close to the perpendicular line as possible in order to preserve proper channeling of the magnetic fields created by the rows of bar magnets.

As shown in FIG. 6, the outer pole elements 40' are shown as being only a half of U in cross section as the outer pole elements must be tapered so as to define the peripheral edges of each frame section, however, the effective width of the inner face or surface area of the outer pole elements is substantially identical to those of the interior pole elements. In view of the foregoing, generally the entire active surface area of the diaphragm is influenced by the magnetic fields created by the rows of magnets. It should be noted, however, that the useful magnetic field is minimal between the opposing pole elements 40. Thus, the portion of the diaphragm in alignment with the inner surfaces of each of the pole elements is undriven. In this respect, it is desired that the width of the face of each of the pole elements be minimize and, in the preferred embodiment, such width is generally not to exceed approximately 0.40 inch. Therefore, the spacing "D", between each of the segments or runs of the electrical circuit should also therefore not exceed approximately 0.25 inch such that the conductor runs are spaced on opposite sides of the pole elements 80 as to be within the magnetic fields created between each of the rows of magnets and the adjacent outer edges of each of the pole elements, as is shown generally in FIG. 7.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A planar magnetic acoustic transducer comprising;

a housing defined by opposing metallic frame sections each having a material thickness of between 0.03 to 0.06 inch, said opposing frame sections defining an open area surrounded by a border portion;

a flexible diaphragm mounted between said border portions of said frame sections so as to create an active diaphragm area within said open areas defined by said frame sections;

an electrical circuit on said active surface area of said diaphragm, said electrical circuit including a plurality of generally parallel conductor segments;

A plurality of permanent magnets mounted in a plurality of spaced rows to each of said frame sections such that said rows of magnets of said frame sections are in opposing relationship with respect to one another on opposite sides and spaced from said diaphragm with like poles of said magnets being in opposing relationship with one another on opposite sides of said diaphragm;

A plurality of pole elements integrally formed with each of said frame sections and extending inwardly toward said diaphragm, said pole elements being spaced intermediate and from each of said rows of said permanent magnets, each of said pole elements being defined by at least one side wall which extends inwardly toward said diaphragm from a rear wall of said frame sections, said at least one side wall being angled at no greater than 40° with respect to a line extending perpendicularly from said rear wall to said diaphragm; and a plurality of elongated openings provided through said rear wall of each of said frame sections between each of said rows of magnets and each of said pole elements to allow acoustic waves to pass therethrough whereby magnetic fields from said rows of magnets are directed generally parallel to said diaphragm from said like poles of said permanent magnets to said pole elements.

2. The planar magnetic acoustic transducer of claim 1 in which each of said permanent magnets includes a height to width ratio of less than 1.

3. The planar magnetic acoustic transducer of claim 2 in which the height to width ratio is such that the height is between 50% and 90% of the width of each of said permanent magnets.

4. The planar magnetic acoustic transducer of claim 3 wherein the height is approximately 75% of the width.

5. The planar magnetic acoustic transducer of claim 1 in which each of said pole elements includes an inner face spaced from said diaphragm, said inner faces having a width not greater that 0.4 inch.

6. The planar magnetic acoustic transducer of claim 5 wherein the inner face of each of said pole elements is substantially co-planar with said like poles of said magnets within said housing.

7. The planar magnetic acoustic transducer of claim 5 in which each of the pole elements is spaced not greater than 0.125 inch from an adjacent row of magnets.

8. The planar magnetic acoustic transducer of claim 1 in which an air gap between the like poles of said magnets and said diaphragm is between 0.03 to 0.07 inch.

9. The planar magnetic acoustic transducer of claim 1 including four rows of magnets mounted to each of said frame sections, each of said rows including three magnets oriented in end-to-end relationship.

10. The planar magnetic acoustic transducer of claim 9 in which said four rows of magnets include two outer rows and two inner rows, said outer rows of magnets being spaced such that center lines thereof are spaced at a distance not greater than approximately 1.875 inch.

11. The planar magnetic acoustic transducer of claim 1 wherein each of said magnets is formed from a material selected from a group of materials consisting of sintered NdFeB and SmCo.

12. The planar magnetic acoustic transducer of claim 11 wherein each of said magnets is coated with a material selected from a group of materials consisting of Nickel, Nickel alloys, Zinc and epoxies.

13. The planar magnetic acoustic transducer of claim 12 wherein each of said magnets have a maximum height of approximately 1.00 inch.

* * * * *